US006790076B1

(12) United States Patent
Patterson

(10) Patent No.: US 6,790,076 B1
(45) Date of Patent: Sep. 14, 2004

(54) BATTERY USEABLE ONLY IN A FIRE/ SMOKE DETECTOR UNIT

(76) Inventor: Stuart M. Patterson, 4207 W. Ruby Ave., Milwaukee, WI (US) 53209

( * ) Notice: Subject to any disclaimer, the term of this patent is extended or adjusted under 35 U.S.C. 154(b) by 0 days.

(21) Appl. No.: 10/759,823

(22) Filed: Jan. 20, 2004

(51) Int. Cl.[7] ..... H01R 3/00

(52) U.S. Cl. ..... 439/500; 320/110; 320/114; D13/103; 429/100

(58) Field of Search ..... 439/500; D13/103, D13/119, 120; 320/107, 110, 112, 114; 429/100, 126

(56) References Cited

U.S. PATENT DOCUMENTS

| | | | | |
|---|---|---|---|---|
| 3,634,846 A | | 1/1972 | Fogiel | 340/521 |
| D247,163 S | | 2/1978 | White | D10/106 |
| 4,147,838 A | * | 4/1979 | Leffingwell | 429/1 |
| 4,171,944 A | | 10/1979 | Hirschmann | 431/22 |
| 5,575,682 A | * | 11/1996 | Alexander | 439/500 |
| 6,137,396 A | * | 10/2000 | Puppo | 340/332 |
| 6,166,519 A | * | 12/2000 | Gault | 320/107 |

* cited by examiner

*Primary Examiner*—Ross Gushi
*Assistant Examiner*—Briggitte R. Hammond
(74) *Attorney, Agent, or Firm*—Donald R. Schoonover

(57) ABSTRACT

A battery has terminals located on one face of the battery rather than on one end of the battery. The terminals are sized and shaped to be accommodated in terminals that are present in the circuits of existing fire/smoke detector units. The battery is a single function battery and is useable only in a fire/smoke detector unit.

1 Claim, 1 Drawing Sheet

BATTERY USEABLE ONLY IN A FIRE/ SMOKE DETECTOR UNIT

BACKGROUND OF THE INVENTION

1. Field of the Invention

The present invention relates to the general art of smoke and fire detectors, and to the particular field of batteries for smoke and fire detectors.

2. Discussion of the Related Art

It has been well documented that smoke and fire detectors and alarm systems save countless lives. Most such devices have some sort of battery. The battery can be a primary source of power for the device or it can serve as a backup source of power.

Whether the battery is the primary source of power or a backup power source, the battery will only work if it is present in the device and in good operating order.

The art has examples of systems intended to check the power level of a battery used in a fire/smoke detector. The art also has systems for detecting a missing battery as well.

While these systems are effective, there is still a problem that is not considered by these devices. The inventor has discovered that some people tend to remove the battery from a fire/smoke detector to use the battery for some other purpose, then forget to replace the battery. For example, children playing a game may find the battery in their game becomes low, and may desire to replace that battery. However, if no other battery is readily available, these children may be tempted to pirate a battery from another device. In some cases, the inventor has found that people will be tempted to pirate the battery from the smoke detector to replace the battery in the system they are presently using.

Of course this is dangerous since loss of the battery may endanger the operation of the fire/smoke detector.

Therefore, there is a need for a means for preventing removal of a battery from a fire/smoke detector.

A counter consideration for providing a means for preventing removal of a battery from a fire/smoke detector is that the battery should be replaceable when needed. That is, the battery cannot be locked into the fire/smoke detector, but must be removable when needed to replace the battery or to otherwise service the detector.

Therefore, there is a need for a means for preventing removal of a battery from a fire/smoke detector but which will permit removal of the battery when it is proper to do so.

However, in order to be most useful, the means used to prevent pirating of a battery from a fire/smoke detector should not require significant modification of the electrical circuit already existing in a fire/smoke detector. This will permit existing units to use the battery.

Therefore, there is a need for a means for preventing removal of a battery from a fire/smoke detector but which will permit removal of the battery when it is proper to do so and which can be used with electric circuits that already exist in presently available fire/smoke detectors.

PRINCIPAL OBJECTS OF THE INVENTION

It is a main object of the present invention to provide a means for preventing removal of a battery from a fire/smoke detector.

It is another object of the present invention to provide a means for preventing removal of a battery from a fire/smoke detector but which will permit removal of the battery when it is proper to do so.

It is another object of the present invention to provide a means for preventing removal of a battery from a fire/smoke detector but which will permit removal of the battery when it is proper to do so and which can be used with electric circuits that already exist in presently available fire/smoke detectors.

SUMMARY OF THE INVENTION

These, and other, objects are achieved by a battery having special terminals on one face of battery rather than on an end of the battery. The face-located terminals of the battery are sized and shaped in the manner of existing end-located terminals so the terminals on the electric circuit in an existing fire/smoke detector unit do not need to be modified and the battery embodying the present invention can be used in place of existing batteries in connection with the fire/smoke detector. Thus, the battery embodying the present invention is a single function battery and is not useful for any purpose other than the special terminal fire/smoke detector; however, it will readily be accommodated by circuits in existing fire/smoke detector units so no changes or modifications are required to use the battery of the present invention in an existing fire/smoke detector unit.

Using the battery embodying the present invention will permit the battery to be used in a fire/smoke detector and to be replaced as needed, and will permit the battery to be used in existing units, but will prevent that battery from being used for any purpose other than to power the fire/smoke detector. The battery embodying the present invention is a single function battery. This will prevent someone from pirating the battery from a fire/smoke detector and then leaving the detector without a battery.

BRIEF DESCRIPTION OF THE DRAWING FIGURES

DETAILED DESCRIPTION OF THE PREFERRED EMBODIMENT

Figure 3:
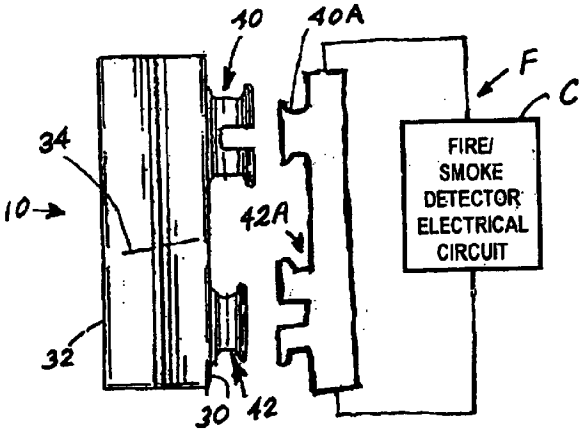
FIG. 3 is a side elevational view of the battery shown in FIG. 1 in combination with a connection terminal of a circuit used in a fire/smoke detector unit.
Figure 2:
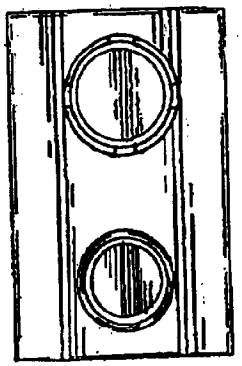
FIG. 2 is a front elevational view of the battery shown in FIG. 1.
Figure 1:
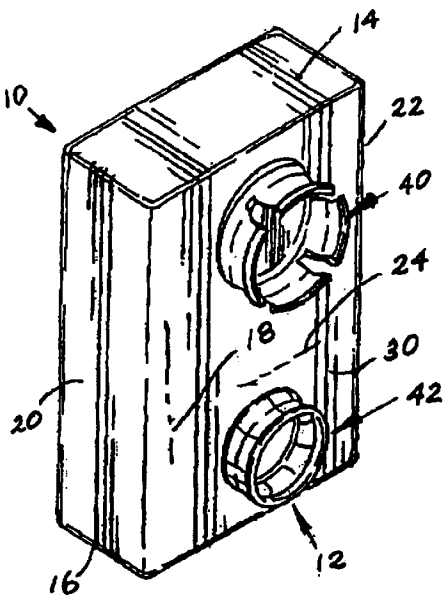
FIG. 1 is a perspective view of a battery adapted for use with a smoke and/or fire detector embodying the present invention.

Other objects, features and advantages of the invention will become apparent from a consideration of the following detailed description and the accompanying drawings.

Referring to the Figures, it can be understood that the present invention is embodied in a single function battery 10 that is used in a fire/smoke detector, and can only be used in such a device. Battery 10 is a nine-volt battery in some forms, but can be other voltages if desired. Battery 10 can be any form of battery, including, but not limited to, an alkaline battery, a mercury battery, or the like.

It is also noted that while the present disclosure is directed to a fire/smoke detector unit, other units, including CO detectors, burglar alarm units, and the like, are to be included in the scope of the present disclosure. Battery 10 can be used as a primary power source for such a unit or can be a backup power source without departing from the scope of the present disclosure.

Battery 10 comprises a body unit 12 which has a first end 14, a second end 16, and a longitudinal axis 18 which extends between the first end 14 and the second end 16. Body unit 12 further comprises a first side edge 20, a second side edge 22, and a transverse axis 24 which extends between the first side edge 20 and the second side edge 22. Body unit 12 further comprises a first face 30, a second face 32, and a thickness dimension 34 which extends between the first face 30 and the second face 32.

All of the sides, ends, faces and edges are planar and open except first face 30.

A first terminal connector 40 is a spring-clip type connector and is located on the first face 30 of the body unit 12. First terminal connector 40 is sized and shaped to be adapted to be electrically connected to an associated terminal connector 40A in a circuit C of a fire/smoke detector unit F.

A second terminal connector 42 is a terminal that is sized and shaped to be associated with and accommodated in a spring-clip type connector and is located on the first face 30 of the body unit 12. Second terminal connector 42 is spaced apart from first terminal connector 40 in the direction of longitudinal axis 18 of the body unit 12. Second terminal connector 42 is adapted to be electrically connected to an associated terminal connector 42A in circuit C of fire/smoke detector unit F.

Circuit C is well known to those skilled in the art, and thus will not be discussed. The terminals 40A and 42A are also well known and are common to fire/smoke detector circuits. These terminals generally accommodate associated terminals on the end of a battery used in such circuits. Thus, the fire/smoke detector circuit in an existing fire/smoke detector need not be changed to accommodate battery 10.

It is understood that while certain forms of the present invention have been illustrated and described herein, it is not to be limited to the specific forms or. arrangements of parts described and shown.

What is desired to be covered by Letters Patent is as follows:

1. A single function battery comprising:

a) a body unit which has a first end, a second end, a longitudinal axis extending between the first end and the second end, a first side edge, a second side edge, a transverse axis extending between the first side edge and the second side edge, a first face, a second face, and a thickness dimension extending between the first face and the second face;

b) a first terminal connector on the first face of said body unit, said first terminal connector being adapted to be electrically connected to an associated terminal connector in a circuit of a fire/smoke detector unit, said first terminal connector being a spring-clip type electrical terminal; and c) a second terminal connector on the first face of said body unit, said second terminal connector being spaced apart from said first terminal connector in the direction of the longitudinal axis of said body unit, said second terminal connector being adapted to be electrically connected to an associated terminal connector in a circuit of a fire/smoke detector unit, said second terminal connector being sized and shaped to be received and accommodated by a spring clip type electrical terminal.

* * * * *